US006405970B1

(12) United States Patent
Ueyama

(10) Patent No.: US 6,405,970 B1
(45) Date of Patent: Jun. 18, 2002

(54) ALIGNIN CORE SHAFT

(75) Inventor: Minoru Ueyama, Katano (JP)

(73) Assignee: Fuji Tekko Co., Ltd., Katano (JP)

( * ) Notice: Subject to any disclaimer, the term of this patent is extended or adjusted under 35 U.S.C. 154(b) by 0 days.

(21) Appl. No.: 09/619,379

(22) Filed: Jul. 19, 2000

(30) Foreign Application Priority Data

Jun. 15, 2000 (JP) ..... 2000-179611

(51) Int. Cl.[7] ..... B65H 75/24

(52) U.S. Cl. ..... 242/573.2; 242/530.3; 242/576.1

(58) Field of Search ..... 242/530.3, 573.2, 242/573.7, 573, 573.9, 576.1; 279/2.06, 2.09, 2.1, 2.11

(56) References Cited

U.S. PATENT DOCUMENTS 4,140,287 A * 2/1979 Hutzenlaub ..... 242/530.3
4,232,835 A * 11/1980 Benin ..... 242/573.9
4,254,920 A * 3/1981 Peterson ..... 242/573.7
4,429,838 A * 2/1984 Lenk et al. ..... 242/573.7
4,911,376 A * 3/1990 Thompson ..... 242/573.2

FOREIGN PATENT DOCUMENTS

JP 57-81046 * 5/1982 ..... 242/530.3
JP 3-106744 5/1991

* cited by examiner

*Primary Examiner*—John M. Jillions
(74) *Attorney, Agent, or Firm*—Flynn, Thiel, Boutell & Tanis, P.C.

(57) ABSTRACT

A core shaft having lugs protruding from its outer circumference to grip winding cores such as a paper tube is provided, wherein the movement of the lugs within a shell of the shaft is inhibited thereby to secure concentrical gripping of the winding cores with the core shaft and to prevent from decentering and vibration or runout of the winding cores, eventually enabling a smooth winding or unwinding of a sheet material. The core shaft has plural sets of the lugs arranged axially in spaced relationship, at least one set of the lugs being disposed circumferentially equidistantly relative to the center of the shaft; an inner core tube for introduction of air disposed in a central part of the shaft; air cylinders having an inclined wall disposed between the inner core tube and the lugs, the inclined wall being axially movable; and slide fittings having a reverse inclined wall disposed in abutting contact with the inclined wall, the slide fittings being fitted with the lugs so that when the inclined walls are displaced by passage of air through the cylinders, the lugs protrude equally or retract from the outer circumference through the slide fittings. The air cylinders may contain therein a spring member with a retainer, a piston for the cylinder and an air chamber for the passage of air, whereby to move the inclined walls with the spring members or pneumatically, thus protruding or retracting the lugs.

3 Claims, 3 Drawing Sheets

ALIGNIN CORE SHAFT

BACKGROUND OF THE INVENTION

1. Field of the Invention

This invention relates to a core shaft holding and gripping winding cores such as a paper tube for use in winding or unwinding of a sheet material, and more particularly, to an aligning core shaft that prevents runout of the winding cores and the resulting decentering.

2. Statement of Related Art

In winders for winding up a sheet material or unwinders thereof, hitherto a core shaft as shown in FIGS. 4 and 5 has been widely used, which is provided with lugs 24 interposing lug stays 23 and leaf springs 25 between a shell 21 of the core shaft and a rubber tube 22 in a manner that the lugs can protrude from the shell 21. The gripping of winding cores A by means of the core shaft is conducted so that when the rubber tube 22 is expanded by air admitted from an air inlet (not shown) into it, the lugs 24 are projected from the outer circumferential part of the shell 21 to come into press contact with the inner diameter of each winding core fitted externally on the core shaft, thus gripping the winding core.

With the conventional core shaft, the rubber tube 22 is located near a radially central part within the core shaft and the magnitude of protrusion of the lugs 24 is set with a sufficient margin to push up the inner surface of the winding core. Because of the construction, when the inside diameter of the shell 21 and the rubber tube 22 are expanded, a still protrudable clearance S' remains between the shell 21 and the lugs 24 retained within the inside core diameter, and the clearance cannot be kept constant. Consequently, the problem is encountered that the lugs 24 are freely movable by the amount of the clearance. The winding core A is therefore not only decentered, but also cannot be gripped concentrically with the core shaft since the winding core sags downwardly owing to the weights of the rubber tube 22 and the lugs 24.

Again, when the winding core A in that state is rotated at high speed, the winding core vibrates, so that the sheet-like material thereon cannot be wound stably and the resulting runout of the core causes a variation in the pass length of the sheet material during winding. The tension of the sheet material fluctuates, resulting in wrinkling of the wound product, accordingly.

On the other hand, another winding shaft device is disclosed in JP Patent First Publication No. 3-106744A (1991), which device is constructed so that grip members movable along inclination surfaces may be outthrusted by introduction of compressed air into a shaft body so as to grip winding tubes. Here, it is required that the device have both chuck mechanisms for gripping the winding tubes and clutch mechanisms for rotating the shaft body, and the clutch mechanisms be positioned inside the chuck mechanisms. Because of the construction, the iron core as the shaft body is inevitably so slender that the strength of the shaft is reduced and a deflection of the shaft is caused. Consequently, there is a defect of the difficulty in meeting a high-speed winding.

In particular, the recent requirement of a high productivity in winding of a film necessitates the winding of a wider film. To that end, the width of a film is enlarged to 2500 to 3000 mm against 1000 to 1500 mm in the past irrespective of the same core diameter of 75 mm as before and the winding speed is raised to 300 to 400 m/min.

Aside from the lugs of the known core shafts described above, another means for gripping winding cores concentrically are also known, namely, thread screws, a link mechanism, etc. However, these constructions are complicated and expensive since a number of components must be incorporated in a small space, considering the comparatively small diameter of the core.

In order to overcome the drawbacks or problems of the prior art core shafts, this invention is designed to provide an improved core shaft of the lug type as stated above. Accordingly, an essential object of the invention is to inhibit the movement of lugs within a shell of the core shaft, thereby securing concentrical gripping of winding cores with the core shaft and avoiding decentering and vibration of the winding cores, even upon high-speed winding of a wide film. Another object is ultimately to permit a smooth winding or unwinding of a sheet material.

SUMMARY OF THE INVENTION

The invention for attaining the aforesaid object resides generally in a core shaft of a required length which comprises, as its outer circumference, a plurality of sets of lugs arranged axially in spaced relationship and each protruding from the outer circumference to come into press contact with an inner surface of a winding core externally mounted, thus gripping the winding core. The core shaft is basically characterized in that at least one set of the lugs are disposed circumferentially equidistantly relative to the center of the core shaft; an inner core tube for the passage of air is disposed in a radially central part of the shaft; air cylinders having an inclined wall of a required angle are provided directly on an outer circumference of the inner core tube between the inner core tube and the lugs so that the inclined wall is axially movable; slide fittings having a reverse inclined wall to the inclined wall of the air cylinder are disposed in a manner that the reverse inclined wall is in facing contact with the inclined wall; and the slide fittings are fitted with the lugs so that when the inner core tube and the air cylinders are in communication with each other and air is moved through the cylinders, the inclined walls are moved to protrude the lugs equally or to retract the lugs from the outer circumferential surface of the shaft through the slide fittings.

More specifically, a first core shaft is characterized in that the slide fittings are fitted with the lugs so that when air is admitted into the inner core tube and the inner core tube communicates with the air cylinders, the inclined walls move to protrude the lugs equally from the outer circumference of the shaft through the slide fittings whereas when air is discharged, the inclined walls move in the opposite direction to retract the lugs from the outer circumference through the slide fittings.

In the foregoing core shaft of the construction that air is required to be always injected during winding, the requirement of perpetual injection of air necessitates the use of a number of air cylinders, which in turn requires a number of seal packings for the air cylinders. As a consequence, even if a leakage of air in a slight amount occurs, air pressure is lowered and the protruding force of the lugs is reduced, with the result that gripping force of securely gripping paper tubes or the like cannot be maintained. For that reason, it is also effective that the need for introduction of air during winding is dispensed with and air is introduced only when fitting or removing paper tubes or the like thereby to retract the lugs. That will do away with the need for an air injection device during winding and impede any reduction in the gripping force due to air leakage during winding. A second aspect of the invention is thus offered.

That is to say, a second winding core shaft is characterized in that at least one set of the lugs are disposed circumferentially equidistantly relative to the center of the core shaft on one circumference thereof; an inner core tube for passage of air is disposed in a radially central part of the shaft; air cylinders having an inclined wall of a required angle are provided directly on an outer circumference of the inner core tube between the inner core tube and the lugs so that the inclined wall is axially movable; slide fittings having a reverse inclined wall to the inclined wall of the air cylinder are disposed each in opposed contact with the air cylinder; the slide fittings are fitted with the lugs; and a spring member is fastened within each air cylinder with its one end attached to a spring retainer and its other end fixed to a cutout in the inclined wall of the air cylinder, thus forming an air chamber capable of admitting therein air between the spring retainer and a piston of the air cylinder; the air chamber being constructed so that during winding, the air chamber is in an evacuated state and the inclined wall of the cylinder is moved in one direction by the biasing force of the spring member to protrude the lugs equally from the outer circumference of the shaft through the slide fittings whereas when winding cores are fitted or removed, the inner core tube and the air chamber are put into communication with each other and air is admitted in the air chamber, while the spring member is compressed to move the inclined wall of the cylinder in the opposite direction thereby to retract the lugs through the slide fittings.

In accordance with the first core shaft relating to the present invention, when winding cores such as a paper tube are inserted thereon, air is supplied from an air port through the inner core tube into the air cylinders, the inclined walls move, and then the slide fittings in opposed contact with the inclined walls are outthrusted circumferentially outwardly. The lugs fitted to the slide fittings thus protrude from the outer circumference of the shaft so as to bring them into contact with the inner surfaces of the winding cores.

At that time, since the lugs are arranged circumferentially equidistantly relative to the center of the winding core, an equal protrusion of the lugs is possible and an alignment of the core shaft is achieved. On the other hand, when air in the air cylinders is evacuated, the inclined walls thereof are displaced circumferentially inwardly by means of a coil spring (not shown) to be restored and the lugs are retracted. The winding cores are thus released easily from the core shaft.

With the second winding core shaft, upon mounting of the winding cores, when air is introduced from an air port through the inner core tube into the air chambers in the air cylinders, the spring members are compressed and the pistons are displaced to move the inclined walls of the cylinders. Concurrently, the slide fittings in facing contact therewith are displaced circumferentially inwardly and the lugs fitted to the slide fittings are retracted from the outer circumference. Accordingly, the mounting operation of the winding cores is easily performed.

In conducting winding process after the mounting of the winding cores, air is evacuated from the air chambers and the biasing force of the spring members is restored. Then the pistons within the cylinders are slidingly moved to the position of the spring retainers. At that time, the inclined walls of the cylinders and the slide fittings in abutting contact therewith are moved circumferentially outwardly to protrude the lugs from the outer circumference so as to bring the lugs into press contact with the inner surfaces of the winding cores thereby gripping them.

Now during winding, air is not introduced and the lugs protrude through the slide fittings while sustaining the inclined walls of the cylinders only by the force of the spring members. Consequently, air leakage never occurs during winding.

After the winding process is finished, in removing the winding cores, air is admitted, as is the case with the mounting thereof. At that time, the pistons of the cylinders are moved to slide by the air pressure and the spring members are compressed by means of the spring retainers to move the inclined walls of the cylinders. Thereby the lugs are retracted through the slide fittings whereby the removal of the winding cores is conducted.

During the aforesaid winding process, since the lugs are arranged to be equal to one another on one circumference relative to the center of the winding cores, an even, equal protrusion of the lugs is possible and alignment of the shaft is attained, accordingly.

PREFERRED EMBODIMENTS OF THE INVENTION

Figure 1:
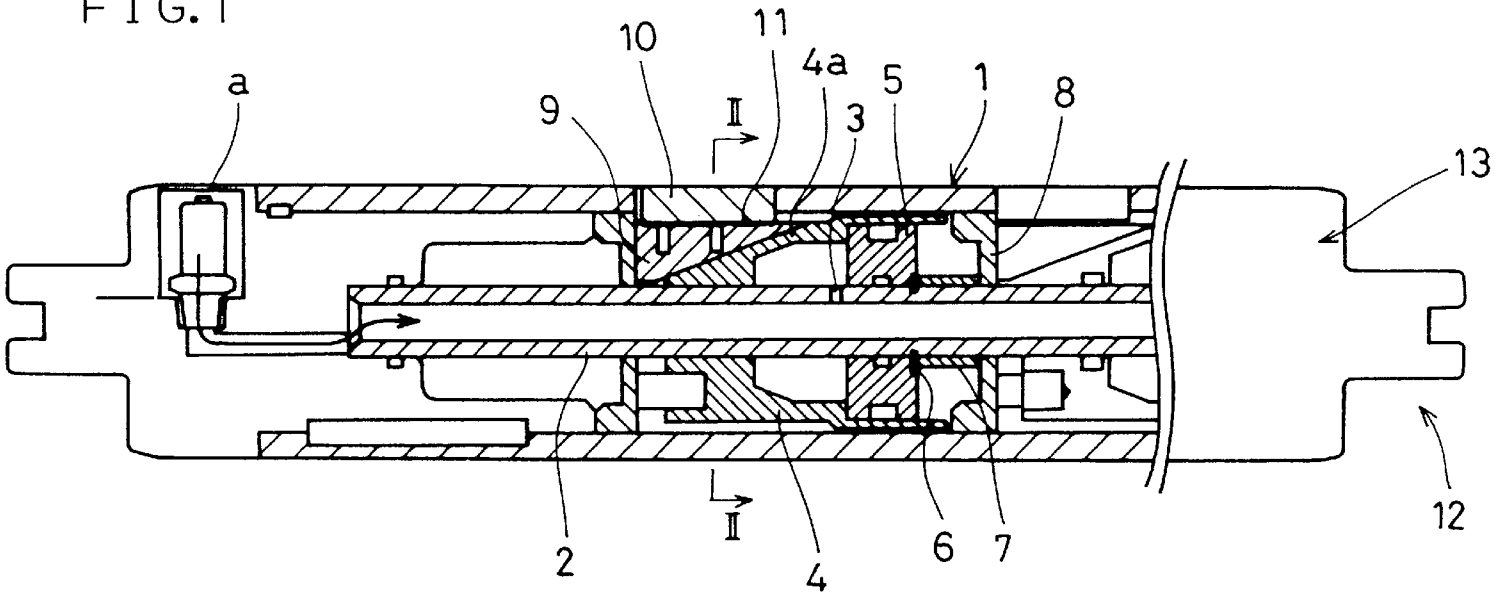
FIG. 1 is a sectional view, partly omitted, of a first example of a core shaft relating to this invention showing its essential construction.

Preferred embodiments of the invention will be hereinafter described in more detail first with reference to FIGS. 1 and 2. In these figures, the reference numeral 1 is a shell of a core shaft of a required length. In the central part within the shell 1, there is disposed an inner core tube 2 whose one terminal communicates with an air port a and which has, in the middle, communication holes 3 with an air cylinder 4, which will be later described.

Around the inner core tube 2, the air cylinders 4 having a piston 5 built-in are directly encircled so as to be axially movable. The contour of the cylinder 4 is configured as an inclined wall 4*a* which is tapered down to one side (left-hand in FIG. 1) to assume a conical inclination. This inclination angle is selected to make a suitable angle to the inner core tube, but is usually in the range of 15 to 30 degrees, more preferably in the vicinity of 20 degrees. The cylinder 4 is, at the other side on the piston 5, attached with a retaining ring 6, outside of which a stopper 8 is disposed, interposing a spacer 7.

Lugs 10 protruding from the outer surface of the core shaft are each fitted to a slide fitting 9 through a leaf spring 11. The slide fitting 9 assumes, at its bottom surface, a reverse inclined wall that is in opposed contact with the inclined wall 4*a* of the cylinder 4, making mutually opposite inclinations. The slide fittings 9 are adapted to move up and down with the movement of the cylinder 4, thereby to protrude or retract the lugs 10 from or into the outer circumference of the shaft. Here, the inclined wall of the cylinder is not necessarily required to be of a smooth surface, but can be grooved so as to fit the slide fittings 9 in the grooves. The reference numerals 12 and 13 are a transmission shaft for transmitting the revolution to the core shaft and a boss, respectively.

Figure 2:
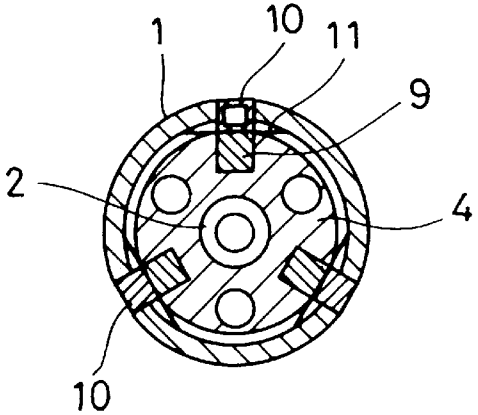
FIG. 2 is a sectional view of FIG. 1 taken along II—II line.

FIG. 2 shows the state of the lugs 10 that they do not yet protrude from the outer surface of the shell 1 of the core shaft. In an ordinary state (non-use), the outer surface of the lug 10 and the outer surface of the shell 1 are flush with each other or the former is slightly depressed from the latter. When the cylinder 4 moves to shift the slide fittings 9 circumferentially outwardly, as described above, the lugs 10 protrude outwardly from the outer surface of the shell 1.

The cylinder 4, the slide fittings 9 and a set of the lugs 10 thus constitute together one unit of a core gripping mechanism. The core gripping mechanisms are installed in a plurality of positions of the core shaft along its length direction. It is also possible to select suitable one or two positions of the plural positions to mount the mechanisms. However, it is efficient that the lugs 10 of one set be arranged mutually equidistantly in plural positions of one circumference of the core shaft. Usually it is preferred to arrange them equidistantly in three positions or four to six positions on one circumference.

With the construction of the lugs 10 thus described, when air is admitted into the air cylinders, the cylinders are moved in a manner to protrude the lugs, by means of which winding cores are fixed and gripped securely on the core shaft. As a consequence, upon winding or unwinding of a sheet material, the winding cores held firmly are free from decentering and causing any runout. Unstability or unreliability of winding or unwinding due to a high-speed rotation is eliminated, and consequently, winding or unwinding by a smooth high-speed rotation can be performed.

Figure 3:
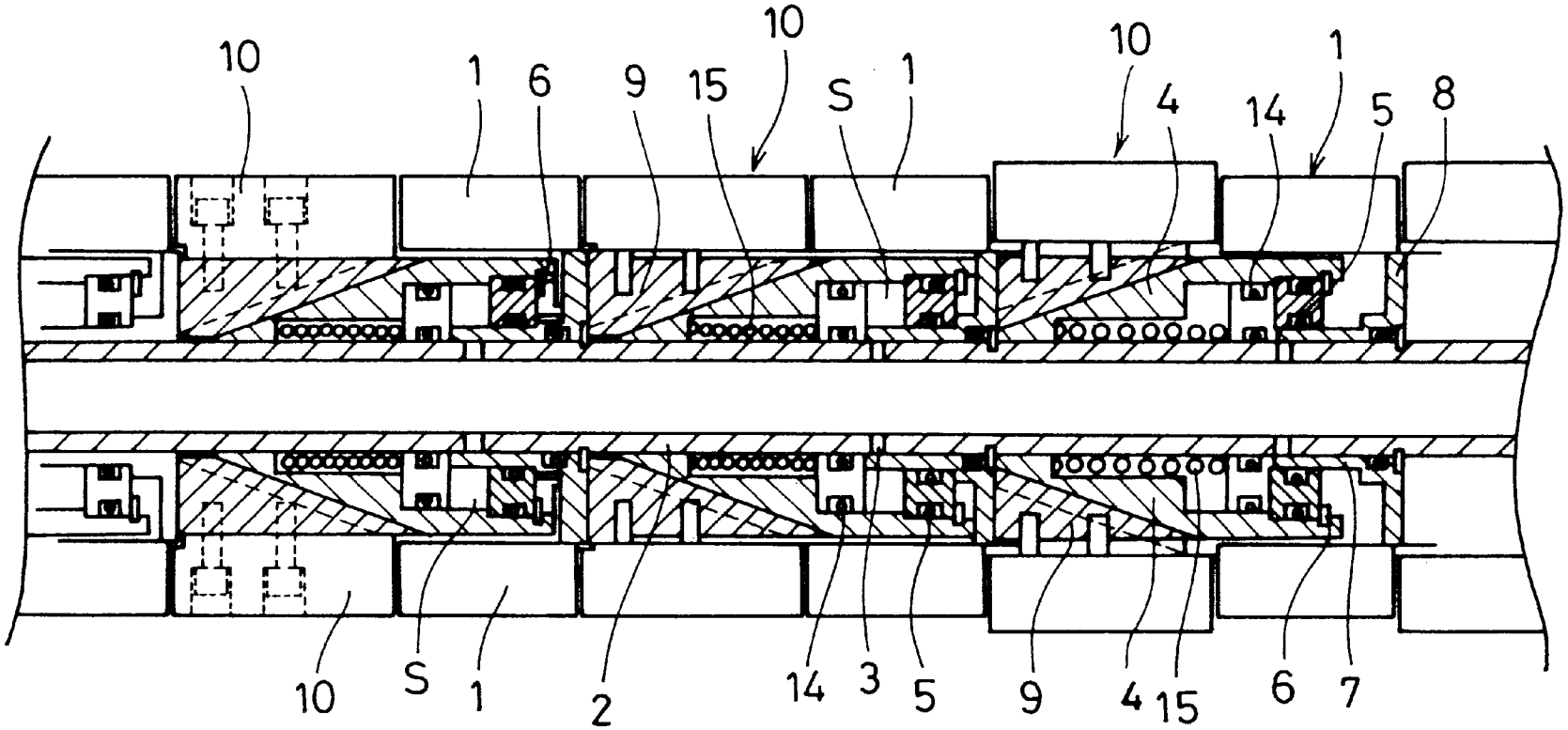
FIG. 3 is a sectional view, partly omitted, of a second example of a core shaft relating to this invention similarly showing its essential construction.
Figure 4:
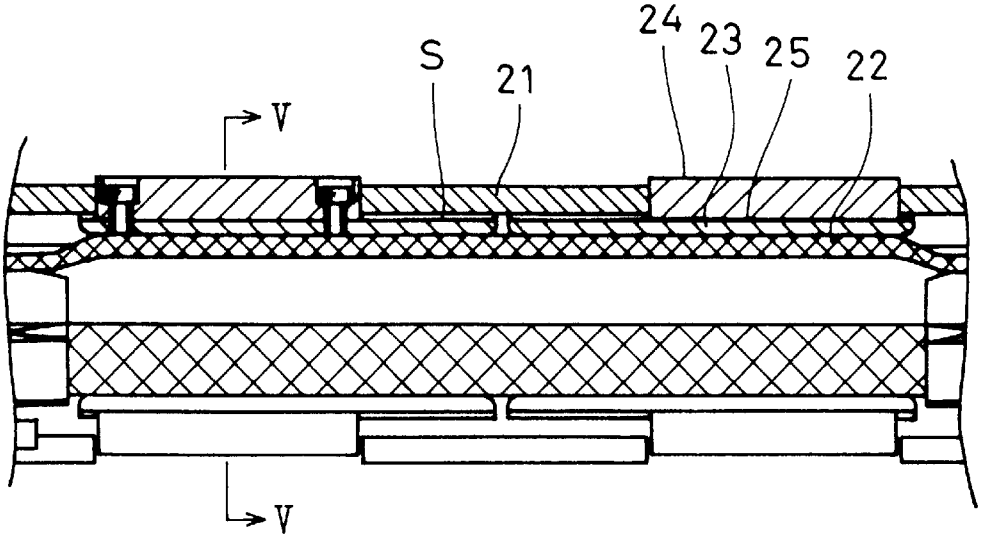
FIG.4 PRIOR ART
FIG. 4 is a partly omitted sectional view of a conventional core shaft of a rubber tube type.
Figure 5:
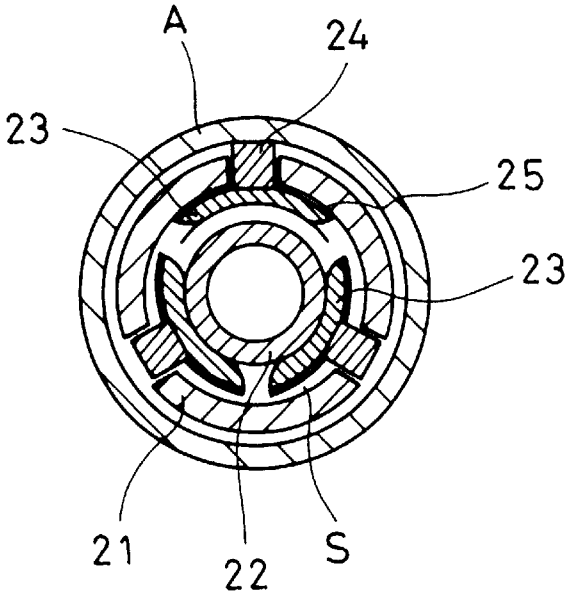
FIG.5 PRIOR ART
FIG. 5 is a sectional view of FIG. 4 taken along V—V line.

Referring to FIG. 3, the fundamental construction of the second core shaft is similar to that of the first core shaft as described above except that it is different in the inner structure of the air cylinder 4. The inner structure of the air cylinder is that the operations of admission and evacuation of air are just opposite to the operations with the first core shaft. When air is evacuated, the lugs protrude from the outer circumferential surface of the shaft to grip the winding cores and winding is performed, whereas when air is admitted, the lugs retract from the outer circumferential surface and are housed in the shaft.

Within the cylinder 4, a spring retainer 14 is fastened to the inner core tube 3; and a spring member 15 such as a coil spring is interposed between the spring retainer 14 and a cutout in the inclined wall 4*a* of the cylinder with its one end attached to the cutout and its other end attached to the spring retainer 14. Further, an air chamber S for introduction of air is formed at the rear side of the spring retainer 14 between it and the piston 5.

In mounting or removing winding cores, air is admitted to move the cylinders to the right-hand direction of FIG. 3 and the lugs 10 are in the retracting state within the shaft. During winding, air is evacuated, and the cylinders are moved to the left-hand of FIG. 3 by biasing force of the spring members to protrude the lugs from the outer circumferential face of the shaft through the slide fittings, whereby the winding cores are reliably gripped by means of the winding core shaft. As a consequence, decentering and runout during winding are prevented, and the unreliability on high-speed rotation fraught with the risk of leakage of air is eliminated. A smooth winding or unwinding by high-speed rotation is thus enabled.

Here, during winding, it is also possible to protrude the lugs by evacuating air to vacuum, instead of the biasing force of the spring members. Further, if the air chamber is brought into a somewhat diminished pressure, it is also possible to cause the lugs to protrude with the aid of the spring members.

To summarize the present invention, in order to avoid the runout of winding cores held by means of a core shaft, the core shaft is constructed so that plural sets of the lugs protruding from the outer circumference of the shaft are arranged axially in plural positions on the core shaft; the cylinders are provided with inclined walls such that the lugs may protrude circumferentially evenly relative to the center of the core shaft; the slide fittings are attached in abutting contact with the inclined walls to be capable of axially moving the cylinders; and the lugs fitted to the slide fittings protrude concentrically. By that construction, it is possible to grip winding cores concentrically with the core shaft, while exhibiting an alignment of the core shaft in the state of gripping the winding cores thereon. The prior art defects that winding cores cannot be concentrically gripped with the core shaft are thus completely overcome, and besides, no runout or vibration of winding cores occurs, even upon high-speed rotation. Further, with a wider film, whose high production efficiency is currently required, a stabilized, smooth winding or unwinding can be performed, without wrinkling due to variation in tension of the sheet material. It is also advantageous that the device of this invention has dispensed with complicated components and can be fabricated at a low cost.

Furthermore, according to the second aspect of the invention, such a measure is taken that in the normal state of winding, the lugs protrude by means of spring members whereas upon mounting or removing of the winding cores, the lugs retract by the admission of air. This obviates the need for the admission of air during winding and no reduction in protrusion force of the lugs occurs owing to leakage of air, accordingly. Since air is injected only upon removal of the winding cores and an air injection device is unnecessary during winding, it is also possible for a worker to introduce air, for example, with a portable air gun, when necessary. The device is thus advantageous in that the cost of it is inexpensive as compared with that of continuous air introduction devices.

What is claimed is:

1. An aligning core shaft for inserting a winding core thereon comprising:

a plurality of sets of lugs disposed in an outer circumference of the core shaft along its elongate direction, the lugs being capable of protruding from the outer circumference to come into press contact with an inner surface of each winding core thereby gripping the winding core, at least one set of lugs being arranged circumferentially equidistant relative to the center of the shaft;

a hollow inner core tube for passage of air therethrough disposed in a radially central part of the core shaft;

air cylinders having an inclined wall of a predetermined angle provided directly on the inner core tube at its outer circumference between the inner core tube and the lugs, the inclined wall being axially movable; and slide fittings having a reverse inclined wall to the inclined walls of the air cylinders and disposed such that the reverse inclined wall is in opposed contact with the inclined wall of the air cylinder, the slide fittings being fitted with the lugs in such a manner that when the inner core tube and air cylinders communicate with each other and air is passed through the air cylinders, the inclined walls thereof move to protrude or to retract the lugs equally from the outer circumference of the shaft through the slide fittings.

2. The aligning core shaft as set forth in claim 1, wherein the slide fittings are fitted with the lugs in such a manner that when the inner core tube and air cylinders are in communication with each other and air is admitted into the air cylinders, the inclined walls thereof move in one direction to protrude equally the lugs from the outer circumference of the shaft through the slide fittings whereas when air is evacuated out of the cylinders, the inclined walls move in the opposite direction to retract the lugs from the outer circumference of the shaft through the slide fittings.

3. An aligning core shaft for inserting a winding core thereon comprising:

a plurality of sets of lugs disposed in an outer circumference of the core shaft along its elongate direction and being capable of protruding from the outer circumference to come into press contact with an inner surface of each winding core, thereby gripping the winding core, at least one set of the lugs being arranged circumferentially equidistant relative to the center of the shaft;

a hollow inner core tube for passage of air therethrough disposed in a radially central part of the core shaft;

air cylinders having an axially movable inclined wall of a predetermined angle provided directly on the inner core tube at its outer circumference between the inner core tube and the lugs, a spring member, a spring retainer, a piston and an air chamber for introduction of air; and slide fittings having a reverse inclined wall to the inclined walls of the air cylinders and disposed such that the reverse inclined wall is in opposed contact with the inclined wall of the air cylinder, wherein the spring member is attached, at one end, to a cutout in the inclined wall of the cylinder and, at its opposite end, to the spring retainer, the spring retainer is fastened to the air cylinder, the air chamber is formed between the spring retainer and the piston so that during winding, the air chamber is evacuated and the inclined wall of the cylinder shifts in one direction by biasing force of the spring member through the slide fittings to maintain the lugs in an equal protrusion state from the outer circumference of the shaft and upon mounting or removal of the winding core, when the inner core tube and air cylinder are in communication with each other and air is introduced into the inner core tube, the spring member is compressed to move the inclined wall of the air cylinder in the direction opposite to said one direction to retract and house the lugs within the shaft through the slide fittings.

* * * * *